United States Patent [19]

Kirk, Jr.

[11] 4,454,965

[45] Jun. 19, 1984

[54] CHILD-RESISTANT TRIGGER PUMP DISPENSER

[75] Inventor: Donald C. Kirk, Jr., Midlothian, Va.

[73] Assignee: Ethyl Products Company, Richmond, Va.

[21] Appl. No.: 297,009

[22] Filed: Aug. 27, 1981

[51] Int. Cl.[3] ..... B67B 5/00; B67D 5/42

[52] U.S. Cl. ..... 222/153; 222/383

[58] Field of Search ..... 222/153, 321, 383, 545; 239/333; 215/218, 219, 221, 222; 220/300, 301, 302

*Primary Examiner*—H. Grant Skaggs

*Attorney, Agent, or Firm*—Donald L. Johnson; John F. Sieberth; E. Donald Mays

[57] ABSTRACT

A child resistant trigger pump dispenser having an elongated, transversely oriented body member with the pump outlet at one end thereof and a vertically extending lower end section for receiving fluid from a container. The lower end section of the pump is equipped with a rigidly attached closure member having a multiplicity of short threads with projections adjacent their ends on the inner wall of the downwardly depending skirt. The container neck is provided on its outside surface with a multiplicity of long interrupted threads, some having recessed portions on their underside adjacent their terminal ends to receive the projections on the short threads on the closure member skirt portion. The closure member is provided with an upstanding boss which is received in an opening provided in the lower portion of the body member for accommodating the trigger arm whereby the transverse axis of the trigger pump can be oriented with respect to the engaging lugs provided on the closure means when the closure member is permanently fixed to the pump. The closure member is fixedly attached to the lower portion of the pump body during assembly so that when the pump is connected to an oval or non-cylindrical container having the long interrupted threads the projections on the short threads of the closure will engage the undercuts on the long threads so that the transverse axis of the pump is in alignment with the major transverse axis of the container to provide fixed orientation of the pump with respect to the container.

6 Claims, 7 Drawing Figures

CHILD-RESISTANT TRIGGER PUMP DISPENSER

BACKGROUND OF THE INVENTION

1. Field of the Invention

This invention relates to a dispensing assembly including a trigger actuated dispenser pump attached to a non-cylindrical container with the longitudinal axis of the pump oriented in the same direction as the major transverse axis of the container.

2. Description of the Prior Art

Trigger actuated, hand-held, pumps have found increasing use in recent years for dispensing numerous products in the form of a fine spray or a stream from hand-held dispensing containers. A large number of various types of commercial trigger pumps are used in dispensing products from packages of household items, such as, glass cleaners, insecticides, spot removers, rug cleaners, bathroom cleaners, and many other household commodities. Additionally these trigger pumps are widely used products which are intended for use in connection with the automotive market i.e., vinyl roof cleaners, vinyl roof protective coating, rubber conditioners, upholster cleaners, tire cleaners, degreasers, etc.

Generally the commercial trigger pumps offered in the present day commercial market are equipped with conventional continuous thread caps which attach the pump to the conventional continuous threaded neck of the container in which the particular product is packaged. In cases where the product is packaged in the cylindrical, "Boston Round" type bottle the loose fit, free turning closure used on conventional pumps has been adequate since no orientation of the pump body is needed in connection with the container since it has a uniformed diameter. Cylindrical containers are generally satisfactory for use with trigger type pumps as long as the container is of a modest size which can be easily gripped by the hand of an adult. However, many products are offered to the consumer market in containers which are generally described as "oval or non-cylindrical" wherein the container has a major and a minor radius i.e., flat fronts and narrow sides which permit larger volume containers to be utilized. In utilizing oval or non-cylindrical containers in connection with trigger actuated pumps which have a body portion having an extended transverse axis there has been a problem of orienting the transverse axis of the trigger pump with the major diametrical axis of the oval or non-cylindrical container so that when the consumer grasps the container the transverse axis of the pump will be directed in the same direction as the major transverse axis of the container. Heretofore there has not been any readily satisfactory commercial mode for assuring that the transverse axis of the pump will coincide with the major transverse axis of the container. Generally, after the produce container is filled, the pump is placed on the container and a mechanical device is used to torque the closure cap on to the container. Even though guide members may be used to maintain the container in its position with the major transverse axis parallel to the conveyor belt it had been difficult to assure that upon final torquing of the trigger pump onto the container that the transverse axis of the trigger pump will coincide with the major transverse axis of the container to produce the desired orientation of the pump with the container.

Another desirable feature to incorporate into a trigger pump dispenser package is the provision of child-resistant closure devices for prevention of the removal of the pump from the container by juveniles. While there are numerous child resistant closures available commercially, one such closure which is receiving increasing commercial acceptance is a safety closure described in U.S. Pat. No. 4,387,817. This closure utilizes a plurality of barbed short lug threads on the cap to engage recesses on longer interrupted threads provided on the container neck. However, to date such child resistant closures have only been utilized in solid top caps for general utility in the packaging market wherein no other devices are required to be attached to the closure member.

One of the more successful trigger pumps presently utilized in commercial product dispensers is the trigger pumps shown in U.S. Pat. No. 4,161,288 and U.S. Pat. No. 4,227,650. This trigger pump has an elongated, horizontally directed housing which is coupled to the container by a conventional continuous thread closure member which rotates freely on the bottom end of the trigger pump. When this pump is attached to an oval container orientation is very difficult to accomplish because it requires maintaining the transverse axis of the pump in line with the major transverse axis of the bottle. This is difficult to achieve because proper torquing of the closure onto the top of the container will prevent proper alignment.

Pumps of the types shown in the foregoing patents and many other commercial pumps do not provide any child-resistant features to prevent children from unscrewing the pump from the container imbibing the contents of the container which may be toxic or deleterious to the child's health.

U.S. Pat. No. 4,159,067 discloses a dispensing pump for containers which utilizes a trigger pump having a transversely extending, longitudinal axis pump that is attached to the container neck by a plurality of latching dogs spaced about the length of the container which engage a like number of matching lugs provided on the interior of the skirt of the closure member. However, the closure member requires an interior auxiliary wedging skirt to fit a specially designed sloping inner wall of the container neck to be compatible and fit closely therewith. Additionally the disclosure of this patent does not provide any solution to the problem of orienting the longitudinal major axis of the dispensing pump with the major transverse axis of an oval container.

In view of the present state of the art in trigger pump dispensing devices it can be seen that there is a need to provide a trigger pump-container combination wherein the major transverse axis of the trigger pump can be specifically and readily oriented to coincide with the major transverse axis of the container to provide for the automatic orientation of the pump during the assembly of the pump to the container on the product filling line. Additionally there is a need to provide a trigger pump-container combination wherein the trigger pump is attached to the container with a closure means having a child resistant feature which will prevent the removal of the pump from the container by a child and possible ingestion of any harmful material in the product container.

SUMMARY OF THE INVENTION

It is an object of the present invention to provide a child resistant trigger pump dispenser.

It is another object of the present invention to provide a child resistant trigger pump dispenser having means to permit orientation of the transverse axis of the trigger pump with the major transverse axis on the container.

It is also an object of the present invention to provide a trigger actuated pump dispenser wherein the closure means is fixedly attached to the pump as a permanent part thereof.

It is another object of the present invention to provide a trigger actuated pump mechanism wherein the number of parts are minimized and the cost of producing the pumps are reduced.

The foregoing objects are achieved in a child resistant trigger pump dispenser having an elongated, transversely oriented body section with the pump outlet at one end thereof and a vertically extending lower end section for receiving fluid from the container. The lower end section of the pump is equipped with a rigidly attached closure member having a multiplicity of engaging means on the inner wall of the downwardly depending skirt. The container neck is provided on its outside surface with a multiplicity of lug threads, some having recessed portions at their terminal ends to receive the projections on the trigger closure skirt portion. The closure member is provided with an upstanding boss which is received in the opening provided in the lower portion of the body member for accommodating the trigger arm whereby the longitudinal or major axis of the trigger pump can be oriented with respect to the engaging lugs provided on the closure means. The closure means is fixedly attached to the lower portion of the pump body during assembly so that when the pump is connected to the oval or non-cylindrical container having the appropriate lug threads the projections on the cap will engage the undercuts on the threads so that the major axis of the pump is in alignment with the major transverse axis of the container to provide fixed orientation of the pump with respect to the container.

The many advantages of the present invention can be utilized on a great number of the commercial trigger pumps presently available in the commercial market other than the trigger pump described in the aforementioned U.S. patents.

Other objects and advantages of the present invention will be more readily apparent from a further consideration of the following detailed description of the drawings and the preferred embodiments of the invention.

DESCRIPTION OF THE PREFERRED EMBODIMENTS

Figure 1:
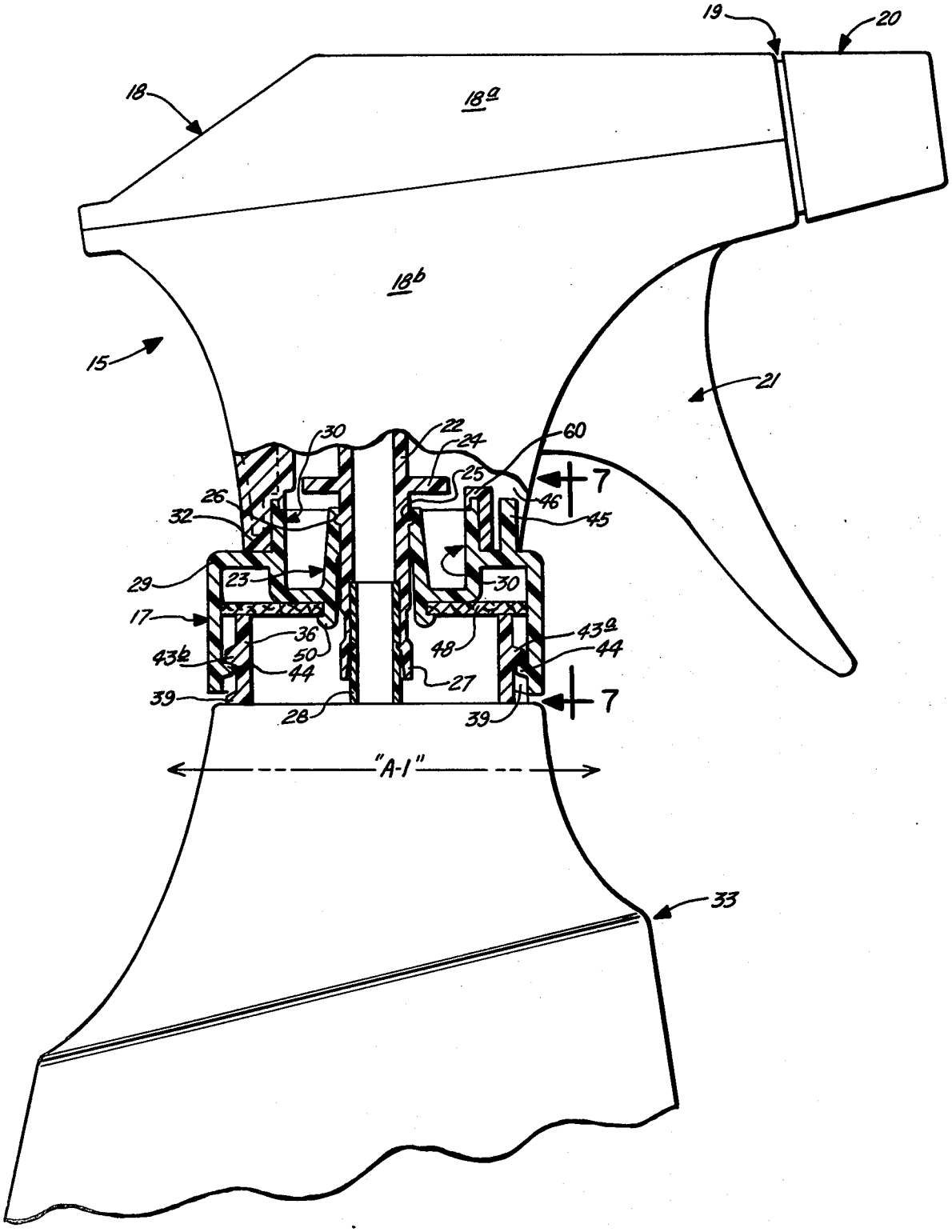
FIG. 1 is a side elevational view of the child resistant trigger pump dispenser according to the present invention, with portions of the pump and container shown in broken section.

Referring now in particular to FIGS. 1, 4, 5 & 6, an embodiment of the child resistant trigger pump dispenser of the present invention is shown which includes a trigger pump, designated generally by the numeral 15, which is attached to the container 33 by means of a closure member 17 which has been fixedly attached to the trigger pump 15. The trigger pump includes a housing 18 consisting of an upper housing member **18*a* and a lower housing member 18*b*. The upper housing member 18*a* and lower housing member 18*b* are preferrably formed by injection molding suitable plastic materials e.g., high density polyethylene, polypropylene, ABS, high impact styrene, etc. The lower housing member 18*b* contains a pump chamber and a piston enclosed therein and an outlet conduit extending from the pump chamber (none of which are shown) to the nozzle 19 of the trigger pump which is closed by nozzle cap 20**. For specific further details of the exemplary trigger pump depicted in the drawings reference is made to U.S. Pat. Nos. 4,161,288 and 4,227,650, the disclosures of which are incorporated herein by reference.

A trigger member 21 is pivotally mounted at its upper end inside the lower housing member **18*b* in the manner described in the above noted patents. The piston, not shown, is provided with a downwardly directed extension tube 22 whose lower end passes through the central annular guide member 23 provided in the closure member 17. The piston extension tube 22 is provided with an annular stop ring 24. Piston extension 22 is provided with an annular bead 25 that is received in the groove 26 in the cylindrical guide member 23 to provide a fluid-tight seal for the trigger pump dispenser device when it is in the "ship or store" position. The lower end 27 of the extension tube has a counter bored portion which tightly and frictionally receives the upper end of dip tube 28. The top annular surface 29 of closure member 17 is provided with an integrally formed, upstanding annular collar member 30. The collar member is provided with inside shoulder portion 31 at its upper end as seen in FIG. 5**.

As seen in FIG. 1 the lower end of the lower housing member **18*b* is provided with a smooth bore recess 60 which fits tightly over the collar member 30, and as will be subsequently described in detail hereafter, the lower end 32 of the housing member 18*b* is rigidly affixed to the top surface 29 of the closure 17 to thereby assemble the closure 17 and pump 15** into a rigid unitary assembly.

Figure 2:
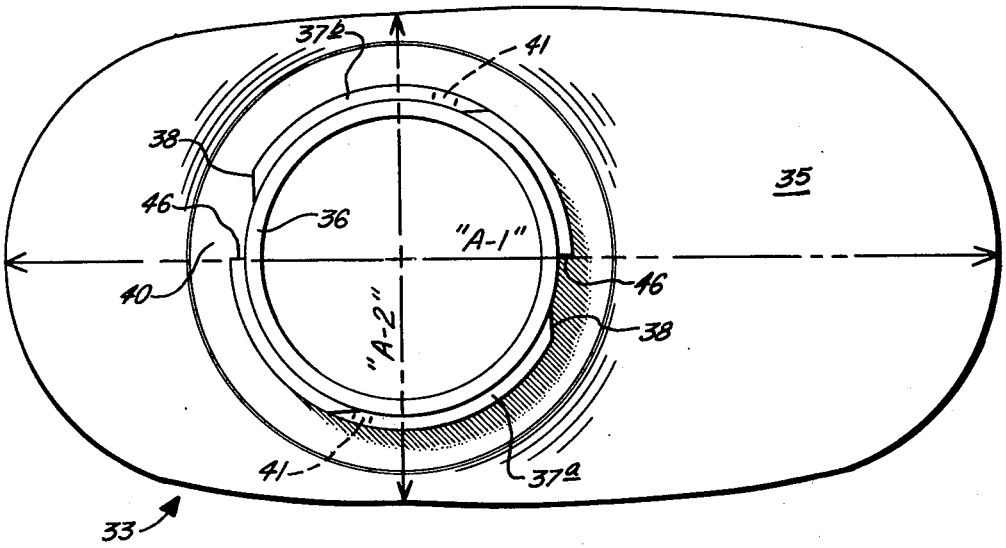
FIG. 2 is a top view of a container adapted for use with the present trigger pump dispenser.
Figure 3:
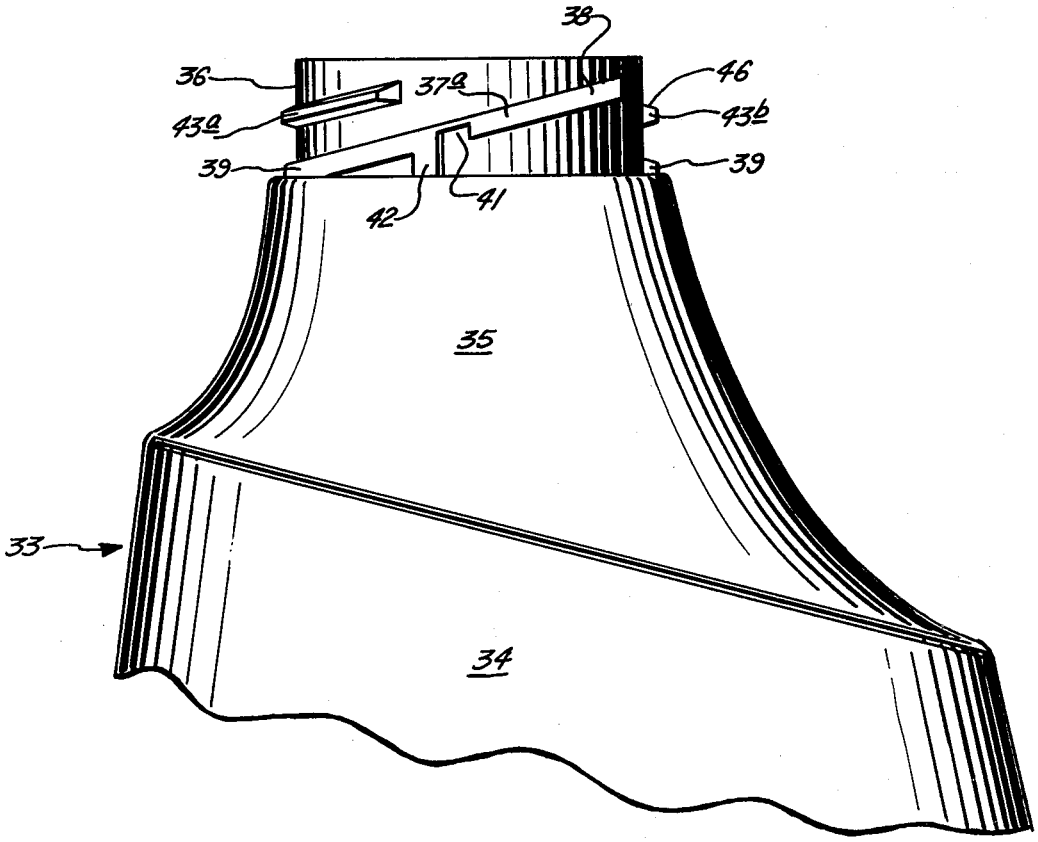
FIG. 3 is a left-hand elevational view of the container of FIG. 2.

While the trigger pump of the present invention is adapted to be utilized with containers of varying styles or shape, it is suited for use with containers that are generally known in the trade as "ovals" or "modified ovals", in particular, those adapted to be easily gripped at a reduced diameter upper portion by hand. Referring in particular to FIGS. 2 and 3 the modified oval container, generally designated by the numeral 33, has an enlarged lower portion 34 and an upper, inwardly tapered portion 35 which is shaped to be readily gripped by the hand of the dispenser user. The container has a neck portion 36 integral with and projecting upwardly from the reduced diameter upper portion 35. The neck 36 of the container is provided with four external lug or interrupted type threads. One pair of long opposed threads **37*a*, 37*b* have their lead ends 38—38** adjacent to the upper end of the neck and their terminal ends 39—39 merging into the shoulder 40 of the upper container portion 35. About midway of the pair of threads 37*a* and 37*b* there is provided a recess or notch 41 in the underside of the respective threads. Immediately forward of the notch 41 is provided an integrally formed stop member 42. The container neck is also provided with a pair of opposed short threads 43*a* and and 43*b* which are positioned about 90° from the long threads 37*a* and 37*b*. Short threads 43*a* and 43*b* are conventional lug threads and do not provide any recesses or cooperating stop members on their undersides.

Figure 4:
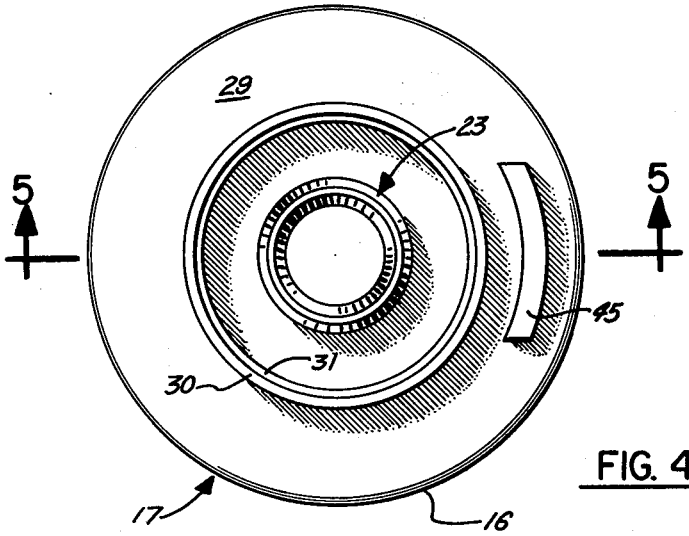
FIG. 4 is a top view of the closure member utilized in the present invention.
Figure 5:
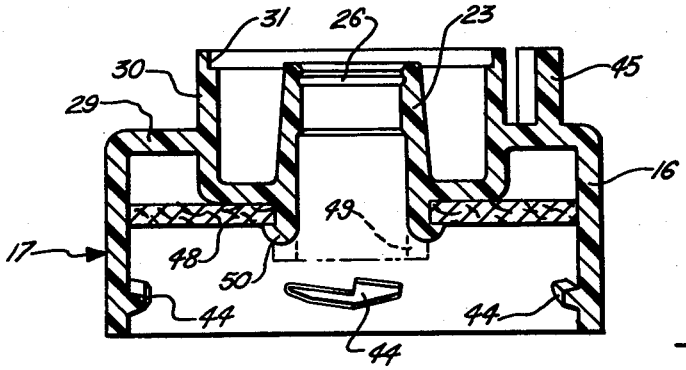
FIG. 5 is an elevational sectional view of FIG. 4 along the lines of 5—5.
Figure 6:
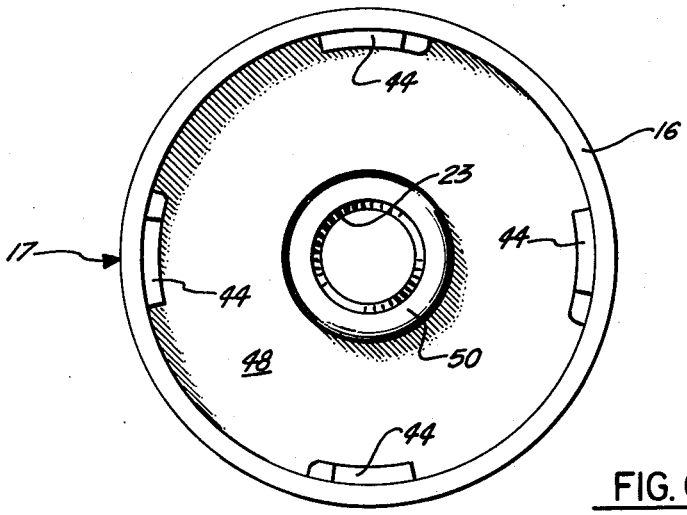
FIG. 6 is a bottom view of FIG. 4.
Figure 7:
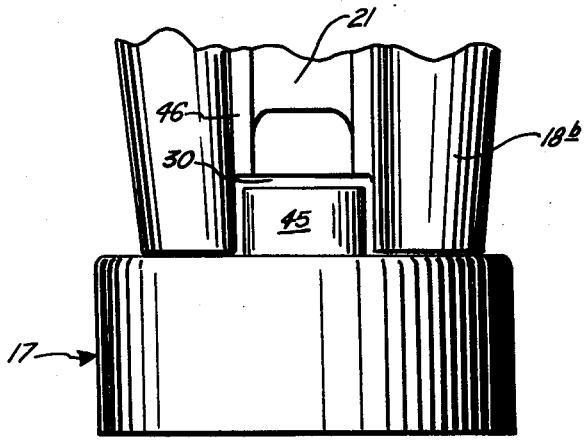
FIG. 7 is an enlarged, fragmentary, elevational, broken view of the lower end of the pump and closure member at the trigger slot opening, oriented along lines 7—7 of FIG. 1.

Referring now to FIGS. 4, 5 and 6 the closure member 17 of the trigger pump assembly is provided with four harpoon-shaped thread members 44 which are spaced approximately 90° apart and are integrally formed on the interior wall of the skirt 16 of closure member 17. One pair of opposed harpoon-shaped thread members 44—44 are adapted to have their barbed end portions engaged in opposed notches 41—41 provided in threads 37*a* and 37*b*. The other opposed set of harpoon-shaped members are adapted to have their barbed end portions engage the terminal ends 46—46 of short thread members 43*a* and 43*b*. For a more detailed description of the thread members on the container neck end the harpoon-shaped thread members on the closure member reference is made to previously noted U.S. Pat. No. 4,387,817. The thread member 44—44 can have protrusions of any shape on the upper surfaces, i.e. they need not be "harpoon-shaped".

The invention has been described in a preferred embodiment but should not be limited to that described and illustrated, it being understood that modifications may be made thereto which are within the ability of those skilled in the art and that the invention described herein should be limited only by the scope of the claims contained herein.

As seen in FIGS. 4, 5, 6 and 7 closure member 17 is provided on its upper surface 29 with an upstanding arcuate shaped boss 45 which is adapted to be loosely received in the bottom of the opening 46 provided in lower housing member 18*b*, which opening receives the trigger member 21 and permits free movement thereof.

To provide automatic orientation of the trigger pump so that the nozzle axis of the pump is parallel to the major transverse axis of the container 33 the long threads 37*a* and 37*b* and the short threads of 43*a* and 43*b* on the container neck are positioned so that their respective notches 41—41 and terminal ends 46—46 engage the harpoon-shaped cooperating threads 44—44 which are positioned on the interior wall of the skirt 16 of closure member 17 to cause the boss 45 on the closure member to be located substantially perpendicular to the transverse major axis A-1 of the container 33 (see FIG. 2).

As seen in FIG. 1 when the closure member 17 is attached to the neck 36 of the container 33 the respective thread members on the interior closure wall and on the exterior of the neck 36 engage to position the boss 45 perpendicular to the major axis A-1 of the container. The trigger pump 15 is then placed on the closure member so that the lower end 32 of the lower housing member 18*b* abuts the top annular surface 29 of the closure member and the boss 45 on the closure member is received in the notch 46 provided in the lower housing member 18*b* thus orienting the nozzle or transverse axis of the trigger pump along the major transverse axis A-1 of the container.

The trigger pump of the present invention is preferably fabricated of plastic material e.g., polypropylene, high density, polyethylene, ABS, polymer, high impact polystyrene, or other suitable injection moldable plastic materials. Also the enclosure member 17 of the present invention is preferably injection molded from suitably rigid or semi-rigid plastic material such as polypropylene, high density polyethylene, acetal polymer, ABS, nylon, or other suitable injection moldable plastic materials. The container utilized with the present invention may be glass, plastic or metal. Preferably the container is made from a plastic material for reasons of economy and lighter weight for the convenience of the consumer. Also the threads on the neck of the container are more precisely formed when plastic material is used to form the container.

To assemble the dispensing apparatus of the present invention the container 33 is filled with a product desired to be dispensed, e.g., a general purpose household cleanser composition, and the container is moved forward on the packaging line to closure attaching station where the closure member 17 is attached to the container with their cooperating thread members as described before so that the boss 45 is oriented with the major transverse axis A-1 of the container. The container—closure unit then next moves to the trigger pump attaching station where the trigger pump 15 is placed on the closure 17 so that the lower end 32 of its lower body member 18*b* is received tightly around the collar 30 on the top of the closure. Also the boss 45 will be received in the slot 46 of the lower housing member 18*b*. The assembly will next move to a sonic welding sealing station where a cylindrical sonic horn, or power source, is not shown, is applied to the underside of the top surface 29 of the closure member and when power is applied the lower end 32 of the lower housing member 18*b* is fused or welded to the top surface 29 to the closure member. Instead of sonic welding an adhesive can be applied to the collar member 30 to permanently affix it to the lower end 32 of the housing member.

Referring to FIGS. 1 and 5 after the collar member 30 is welded to the lower end of the housing the closure member 17 has permanently attached thereto an annular gasket-spring member 48. The gasket member is preferably made from a resilient thermoplastic material e.g., high density polyethylene, foamed polypropylene, nylon, or a multi-layer composite of plastic materials having impervious outer layers of a plastic such as high density polyethylene, and an inner core of a foamed thermoplastic such as low density polyethylene or polystyrene. The gasket 48 is assembled to the lower end 49 of the central cylindrical guide member 23 by applying a heated cylindrical tool (not shown) to the lower end 49, as shown in dotted outline in FIG. 5, and compressing and rolling the lower end until it forms a bead member 50 as seen in FIGS. 1 and 5. Alternatively the gasket can be attached by means of sonic welding or by means of an adhesive. As described in the previously mentioned U.S. Pat. No. 4,387,817, the spring-gasket member 48 when in contact with the lip of the neck of the container maintains an upwardly directed force on the closure member 17 to firmly engage the harpoon-shaped threads on the closure with the recesses 41—41 on the long threads and the terminal ends 46—46 of the short threads.

One of the problems that occurs when dispensers are attached to container necks using the conventional thread engagement between a free rotating closure and the threaded neck portion of a container is the problem of thread "back-off" after the dispenser assembly leaves the packaging line. Cold flow of the plastic threads in the closure and container often results in a leaking package. Also thermal expansion and contraction of the plastic closure and container neck can result in leakage. Additionally constant bumping of trigger pumps against each other in the cardboard containers during shipment can cause loosening of the closure threads on the container resulting in leaking packages. The present invention obviates the foregoing leakage problems since it positively locks the closure to the container neck thus preventing "back-off" and any resultant leakage.

The trigger pump dispenser of the present invention thus provides a child resistant assembly wherein the trigger pump is automatically and permanently oriented so that its nozzle axis is parallel to the major transverse axis of the container. Thus the trigger pump can not be rotated inadvertently during shipping or handling by the ultimate user. Additionally the trigger pump dispenser of the present invention is child resistant by virtue of the interlocking thread arrangements used on the neck of the container and the inner wall of the closure member to prevent the removal by a child. However, an adult user is able to open the assembly for refilling with an additional supply of the original product or to place other product in the container for subsequent dispensing merely by pressing downwardly on the trigger pump to disengage the lug threads on the closure from the recessed thread portion of the neck threads on the neck of the container.

The invention has been described in a preferred embodiment but should not be limited to that described and illustrated, it being understood that modifications may be made thereto which are within the ability of those skilled in the art and that the invention described herein should be limited only by the scope of the claims contained herein.

What is claimed is:

1. A pump for dispensing fluids from a non-cylindrical container that has a major transverse axis and a threaded neck portion, said pump comprising:

(a) a pump housing having a vertically disposed lower housing member with a fluid inlet at its lower end, and is fixedly attached at its upper end to an elongated upper housing member which has its major axis transverse to said lower housing and which has a fluid outlet at one end thereof;

(b) fluid pumping means for pumping fluid from said fluid inlet through said fluid outlet;

(c) closure means fixedly connected to said lower end of said lower housing member, said closure means having a downwardly extending skirt portion that is provided with at least two thread members on its interior wall, which thread members have upwardly extending projections at their leading ends which are adapted to be received in notches provided in the underside of said threads on said neck portion;

(d) cooperating orienting means provided on said closure means and said lower end of said lower housing member adapted to be engaged by relative rotation between said closure means and said lower end of said lower housing member prior to fixedly connecting said closure means to said lower end of said lower housing member;

(e) means fixedly connecting said closure means to said lower end of said lower housing, said means being applied after said cooperating orienting means are engaged;

(f) said threads on said neck portion and said threads on said closure skirt being so positioned with respect to each other after said closure means is fixedly connected to said lower end of said lower housing that when said upwardly extending projections on said threads on said closure skirt are received in said notches in said threads on said neck portion, the major axis of said upper housing member is substantially aligned with said major transverse axis of said non-cylindrical container; and (g) resilient means to maintain engagement between said notches on said threads on said neck portion and said projections on said thread members on said closure means.

2. The pump of claim 1, wherein said closure means is formed as a separate member independent of said pump housing and is then oriented with respect to said lower end of said pump housing and is then permanently aligned therewith, whereby the transverse axis of said pump housing will correspond substantially to said major transverse axis of said container.

3. In the pump of the claim 1, wherein said closure is provided with an upwardly extending collar on its upper surface which is received in an opening provided in the inlet end of said lower housing when said closure threads are engaged with said threaded neck portion.

4. The pump of claim 1, wherein said resilient means is a resilient gasket-spring member and said closure is provided with a hollow central cylindrical portion, the lower end of which is provided with a bead member which grips said gasket-spring member.

5. The pump of claim 4, wherein said hollow central cylindrical portion of said closure is formed integrally with the other portions of said closure.

6. A pump for dispensing fluids from a non-cylindrical container that has a major transverse axis and a threaded neck portion, said pump comprising:

(a) a housing having an inlet end and outlet end and a vertically disposed pump chamber provided with a piston received therein, said piston being actuated by a trigger pivotably mounted on said housing and having a vertically extending opening provided in a wall located at said inlet end of said housing;

(b) closure means fixedly connected to said inlet end of said housing, said closure having means for attaching said pump to said container including downwardly extending skirt portion, said closure further providing an upward extending boss which is received in the lower end of said vertically extending opening in said inlet end of said housing, whereby said pump can be oriented on said closure prior to said closure being fixedly attached to said inlet end of said housing; and (c) said closure being provided with a plurality of arrowhead-shaped threads on the inner wall of the said skirt, and said neck portion of said container being provided with a multiplicity of interrupted threads which threads include a notch in the underside of each of said threads adjacent to the forward end portion of each thread, said notch receiving the arrowhead-shape portion of the respective threads on said closure and said threads on said neck portion being so positioned with respect to each other that said pump is fixedly positioned with the transverse axis of said housing substantially parallel to said major transverse axis of said container when said pump is attached to said container.

* * * * *